United States Patent [19]

Harel

[11] Patent Number: 4,759,382

[45] Date of Patent: Jul. 26, 1988

[54] SYSTEM OF HOT AND IMMEDIATE WATER FOR TAPS-WATER AND ENERGY SAVING

[76] Inventor: Zeev Harel, Burla 30, Tel Aviv, Israel

[21] Appl. No.: 37,539

[22] Filed: Apr. 13, 1987

[30] Foreign Application Priority Data

Apr. 20, 1986 [IL] Israel ..... 78547

[51] Int. Cl.[4] ..... E03C 1/02

[52] U.S. Cl. ..... 137/564; 137/334; 137/561 A

[58] Field of Search ..... 137/334, 337, 561 A, 137/563, 564; 165/142; 285/133.1

[56] References Cited

U.S. PATENT DOCUMENTS 2,163,599 6/1939 Houdry ..... 165/142 X 3,097,661 7/1963 Lee ..... 137/564 X

FOREIGN PATENT DOCUMENTS 69700 2/1915 Austria ..... 165/142

*Primary Examiner*—Gerald A. Michalsky

*Attorney, Agent, or Firm*—James & Franklin

[57] ABSTRACT

The present invention consists in a distributing unit to be connected to a central hot water supply system, said unit comprising a housing consisting of two longitudinally extending pipes located one within the second, a number of primary pipes located in pre-determined distances and extending perpendicularly to said longitudinal pipes and terminating in the outer one; and secondary pipes extending within said primary pipes and terminating in the inner one of said longitudinal pipes. The invention also consists in a central hot water supply system which comprises such distributing unit.

1 Claim, 2 Drawing Sheets

SYSTEM OF HOT AND IMMEDIATE WATER FOR TAPS-WATER AND ENERGY SAVING

The present invention relates to a new central system for supplying hot water in houses, hotels, laboratories, stores, etc.

In commercial available central hot water supply systems the moment the tap of the hot water at a particular point in the flat is closed a hydrostatic block is created in the main pipe system, hot water stops to circulate and the water adjacent to said tap cools down. The moment one opens said water tap again cold water flows at the beginning outwards and some time is required until hot water is received. This means that there is a serious loss of water, energy and time.

It has thus been desirable to design a central hot water supply system which overcomes said drawback, i.e. in which the hot water circulates continuously and the moment the particular tap is opened hot water flows outward. Said system should be simple in its construction, easy to manufacture, adaptable to any commercial system and be relatively cheap.

The present invention thus consists in a distributing unit to be connected to a central hot water supply system, said unit comprising a housing consisting of two longitudinally extending pipes located one within the second, a number of primary pipes located in pre-determined distances and extending perpendicularly to said longitudinal pipes and terminating in the outer one; and secondary pipes extending within said primary pipes and terminating in the inner one of said longitudinal pipes; the outer longitudinal pipe being provided with an inlet and closed at the other end and the secondary pipe being provided with an outlet and closed at the other end.

The primary pipes are connected advantageously to the taps provided in the various locations, respectively, i.e. the washing basin in the bath room and in the kitchen, the bath, the douche or the like.

The secondary pipe is preferably a little bit shorter than the corresponding primary pipe, i.e. it does not reach the tap.

The housing and the central system proper may be made from any suitable material, e.g. steel, copper, or the like.

The primary and the secondary pipes may be made from any suitable metal or plastic material, e.g. copper, P.V.C. or the like.

The size of the unit and/or of the entire system as well as the number of primary and corresponding secondary pipes are no critical features of the present invention. Said features may be detrmined according to the requirements of the customer. A separate distributing unit is preferably provided for each flat and the number of primary and corresponding secondary pipes therein correspond to the number of hot water taps present in said flat.

The present invention consists also in any central hot water supply system which comprises a distributing unit as described above.

The central system utilised may be any conventional one. The source of energy may be any conventional one, e.g. gas, electricity, fuel and/or solar energy.

The various parts may be connected to each other by any conventional means, e.g. nipples, screws, welding or the like.

The present invention will now be illustrated with reference to the accompanying drawings without being limited by same. For order of clarity only one of various identical parts is marked by a reference numeral. Identical parts appearing in various drawings are marked with identical numerals.

Figure 1:
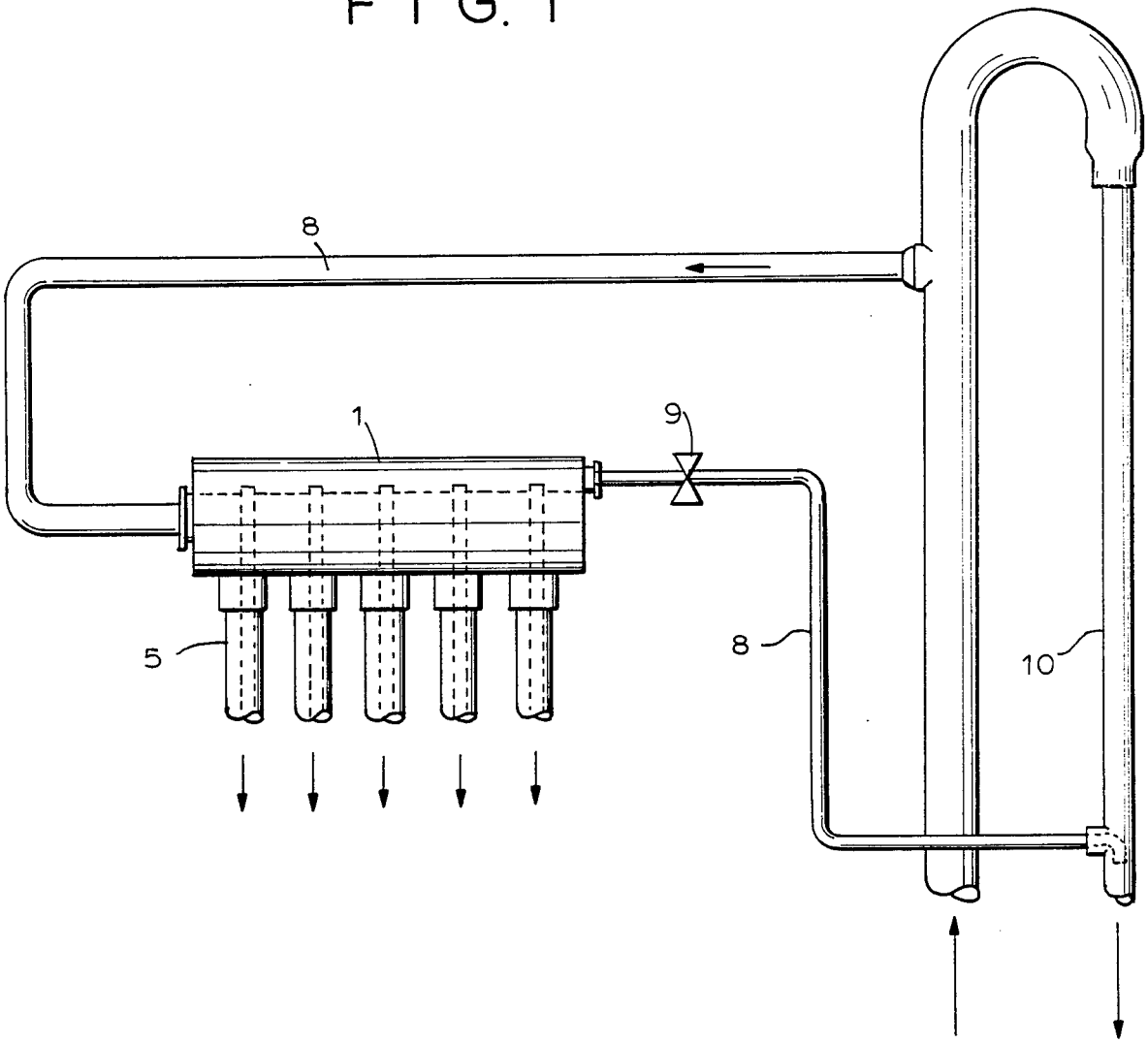
FIG. 1 shows a general view of a central hot water supply system in accordance with the present invention.
Figure 2:
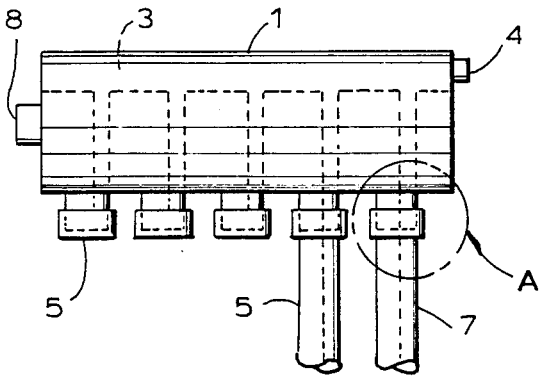
FIG. 2 shows a distributing unit in accordance with the present invention.
Figure 2A:
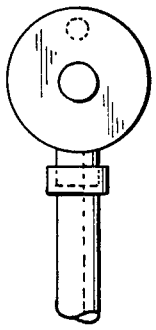
Figure 2B:
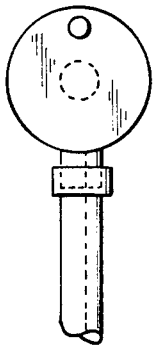
Figure 3:
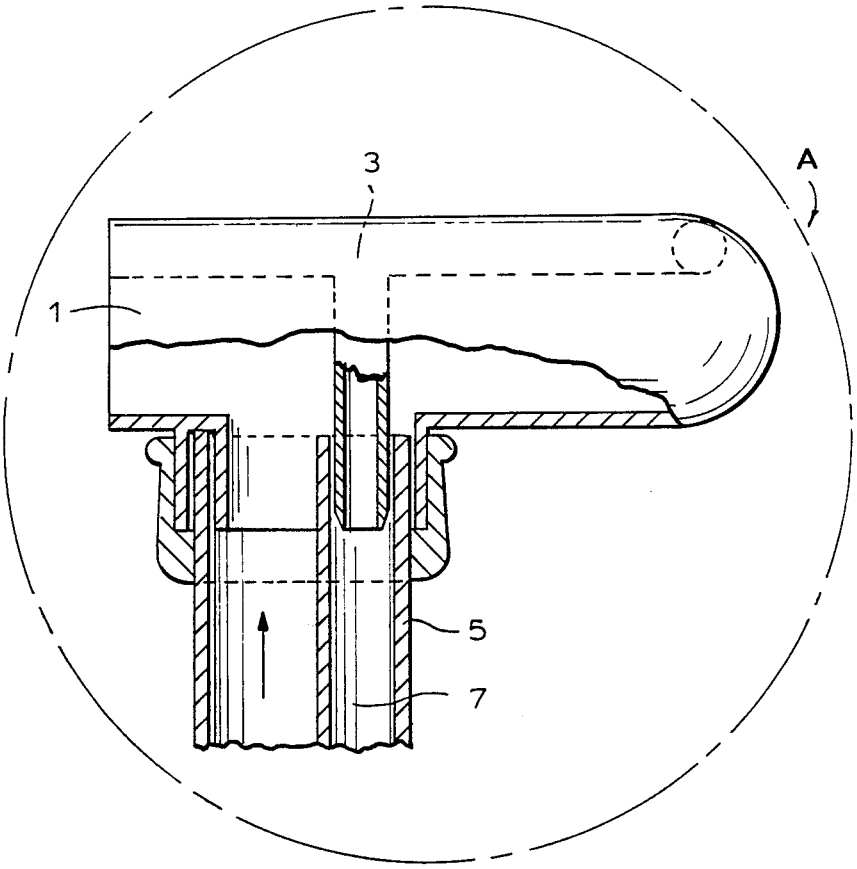
Figure 4:
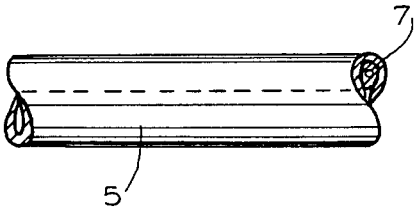
Figure 4A:
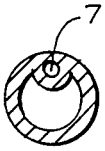

FIGS. 2*a* and 2*b* show views of both sides of the unit shown in FIG. 2;

FIG. 3 shows an enlarged detail A of FIG. 2;

FIG. 4 shows a section of primary and secondary pipe;

FIG. 4*a* shows cross section IV—IV of FIG. 4; and

Figure 5:
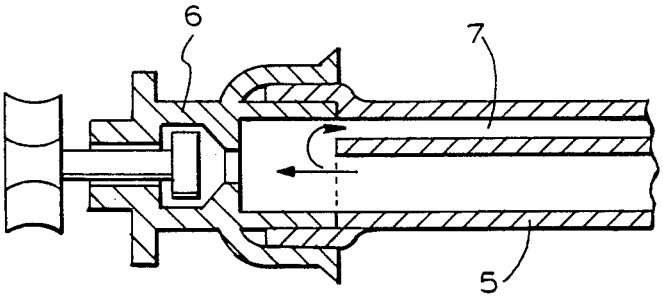

FIG. 5 shows a connection of the primary pipe to a tap.

The distributing unit illustrated in the drawings comprises longitudinal pipe 1 provided with inlet 2 and longitudinal pipe 3 located within pipe 1 provided with outlet. Perpendicularly to pipe 1 and terminating therein extends primary pipe 5 terminating at tap 6. Within pipe 5 extends secondary pipe 7 terminating at pipe 3.

The central system comprises, besides said distributing unit, pipe system 8 extending within the flat. Within said pipe system 8 is located main tap 9 which opens the flow of the water of the central system.

Said system 8 is connected to central pipe system 10 of the entire house. Said system 10 is connected to a container (not shown) in which the water is heated by any conventional available source of energy (not shown).

The hot water circulates as illustrated by the arrow. The water enters the distributing unit through inlet 2 into pipe 1 and from there to tap 6. Should tap 6 be open hot water flows outward. Otherwise it flows through pipes 7 and 3 and outlet 4 and enters again in system 8. It is readily understood that thus a continuous flow of hot water is ascertained.

I claim:

1. Hot water distribution means adapted to be connected as a part of a system for continuously supplying hot water to a plurality of outlet taps, the system being of the type having a supply pipe with continuously circulating hot water, including a supply port and a return port, the distribution means comprising first and second main pipes, said second main pipe being located within said first main pipe, means for connecting said first main pipe to the supply port, means for connecting said second main pipe to the returnport, a plurality of distribution pipes connecting different ones of the taps with said distribution means, each of said distribution pipes comprising first and second branch pipes, said second branch pipe being situated within said first branch pipe, means for connecting said first branch pipe between said first main pipe and one of said taps, said second branch pipe being shorter than said first branch pipe such that hot water continuously circulates from said first main pipe, along said first branch pipe, through said second branch pipe and into said second main pipe, when said one of said taps is closed.

* * * * *